US005508725A

United States Patent [19]

Goto et al.

[11] Patent Number: 5,508,725

[45] Date of Patent: Apr. 16, 1996

[54] INK JET HEAD HAVING TRAPEZOIDAL INK PASSAGES, INK CARTRIDGE AND RECORDING APPARATUS WITH SAME

[75] Inventors: Akira Goto, Yokohama; Kazuaki Masuda, Sagamihara; Takashi Watanabe, Yokohama; Kunihiko Maeoka, Kawasaki; Nobuyuki Kuwabara, Tokyo; Shigeaki Tanaka; Masaaki Izumida, both of Kawasaki; Koichi Sato; Tsuguhiro Fukuda, both of Yokohama; Hiroshi Sugitani, Machida; Yoshifumi Hattori, Yamato; Masami Ikeda, Tokyo; Asao Saito, Yokohama; Akio Saito, Hadano; Tsuyoshi Orikasa, Kasukabe, all of Japan

[73] Assignee: Canon Kabushiki Kaisha, Tokyo, Japan

[21] Appl. No.: 317,028

[22] Filed: Oct. 3, 1994

Related U.S. Application Data

[63] Continuation of Ser. No. 976,674, Nov. 16, 1992, abandoned, which is a continuation of Ser. No. 583,335, Sep. 17, 1990, abandoned.

[30] Foreign Application Priority Data

| | | | |
|---|---|---|---|
| Sep. 18, 1989 | [JP] | Japan | 1-241024 |
| Sep. 18, 1989 | [JP] | Japan | 1-241028 |
| Sep. 18, 1989 | [JP] | Japan | 1-241041 |

[51] Int. Cl.[6] ..... B41J 2/05

[52] U.S. Cl. ..... 347/65; 347/63; 347/56

[58] Field of Search ..... 347/47, 56, 63, 347/65; 29/890.1

[56] References Cited

U.S. PATENT DOCUMENTS

| | | | |
|---|---|---|---|
| 4,007,464 | 2/1977 | Bassous et al. | 346/75 |
| 4,209,794 | 6/1980 | Kattner | 346/140 R |
| 4,216,477 | 8/1980 | Matsuda et al. | 346/140 R |
| 4,313,124 | 1/1982 | Hara | 346/140 R |
| 4,345,262 | 8/1982 | Shirato et al. | 346/140 R |
| 4,450,455 | 5/1984 | Sugitani et al. | 346/140 R |
| 4,459,600 | 7/1984 | Sato et al. | 346/140 R |
| 4,463,359 | 7/1984 | Ayata et al. | 346/1.1 |
| 4,504,844 | 3/1985 | Ebi et al. | 346/140 R |
| 4,558,333 | 12/1985 | Sugitani et al. | 346/140 R |
| 4,575,737 | 3/1986 | Vermot-Gaud et al. | 346/140 R |
| 4,587,534 | 5/1986 | Saito et al. | 346/140 R |
| 4,723,129 | 2/1988 | Endo et al. | 346/1.1 |
| 4,740,796 | 4/1988 | Endo et al. | 346/1.1 |
| 4,863,560 | 9/1989 | Hawkins | 346/140 R X |
| 5,059,973 | 10/1991 | Watanabe | 346/1.1 |
| 5,216,448 | 6/1993 | Unosawa et al. | 346/140 R |
| 5,361,087 | 11/1994 | Tajima et al. | 347/47 X |

FOREIGN PATENT DOCUMENTS

| | | | |
|---|---|---|---|
| 54-056847 | 5/1979 | Japan . | |
| 0049274 | 4/1980 | Japan | 346/140 R |
| 59-123670 | 7/1984 | Japan . | |
| 59-138461 | 8/1984 | Japan . | |
| 60-071260 | 4/1985 | Japan . | |
| 0087056 | 5/1985 | Japan | 346/140 R |
| WO890921 | 2/1989 | WIPO . | |

*Primary Examiner*—Peter S. Wong
*Assistant Examiner*—Eric Frahm
*Attorney, Agent, or Firm*—Fitzpatrick, Cella, Harper & Scinto

[57] ABSTRACT

An ink jet head includes a first member provided with an ejection energy generating element for generating energy contributable to ejection of ink; a second member provided with a recess for defining an ink passage with a trapezoidal cross-section by being coupled with the first member, corresponding to the ejection energy generating element; and a third member provided with an ejection outlet which communicates with the ink passage and through which the ink is ejected.

14 Claims, 13 Drawing Sheets

INK JET HEAD HAVING TRAPEZOIDAL INK PASSAGES, INK CARTRIDGE AND RECORDING APPARATUS WITH SAME

This application is a continuation of application Ser. No. 07/976,674 filed Nov. 16, 1992, now abandoned, which is a continuation of application Ser. No. 07/583,335 filed Sep. 17, 1990, now abandoned.

FIELD OF THE INVENTION AND RELATED ART

The present invention relates to an ink jet recording head, an ink jet recording cartridge having the recording head, and an ink jet recording apparatus having the recording cartridge. The present invention further relates to an ink jet cartridge having a integral recording head and ink container. It further relates to an ink jet recording apparatus wherein the integral type ink jet cartridge scans a recording material.

Recently, a laser beam capable of oscillating ultraviolet light beam, such as excimer laser, or 4-folded YAG laser, has been used to form an orifice of such a recording head. The orifice forming process using the ultraviolet laser beam is as follows.

(1) A resin film constituting the orifice plate is mounted to the opening surface in which an opening communicating with the ink passage is formed, and thereafter the ultraviolet laser beam is applied.

This is shown in FIG. 1, in which reference numeral 101 designates an ultraviolet laser generator; 102 designates a laser beam generated by the laser generator; 103*a*, 103*b* and 103*c* designate a lens system; 104 designates a mask having all or part of the orifice pattern; 105 designates an ink jet recording head in which the resin film is mounted on the opening surface of the ink passage; and 106 designates a movable stage.

FIG. 2 shows the recording head 105 in which such orifices are formed through this process. FIG. 2 is a sectional view thereof. In this Figure, reference numeral 202 designates a top plate having grooves constituting the ink passages; 203 designates a base plate provided with energy generating elements 207 for generating energy contributable to liquid ejection; 204 designates an orifice plate made of resin film; and 205 designates orifices (ejection outlets) formed in the orifice plate 204. Further, reference numeral 206 designates an ink passage.

The energy generating element 207 is in the form of an electrothermal transducer, for example.

As shown in FIG. 2, the configuration of the orifice 205 produced by the conventional method shown in FIG. 1 is diverging in the direction of the ejection.

A description will be made as to the case of using an excimer laser beam rather than an ultraviolet laser.

In FIG. 3, reference numeral 301 designates an excimer laser generator, 302 a laser beam oscillated by the laser generator; 303*a*, 303*b* and 303*c* designate an optical lens system; 304 designates a projection mask having the ejection outlet pattern (orifice pattern); 305 designates a ink jet recording head in which the resin film is mounted on the opening surface of the ink passage; and 306 designates a movable stage.

FIG. 4 shows an example of the ink jet recording head 305 in which the ejection outlets are formed through the above process. FIG. 4 is a perspective view thereof. In this Figure, a reference numeral 401 designates a top plate having grooves constituting the ink passages; 402 designates a base plate provided with energy generating elements; 403 designates openings communicating with the ink passages; 404 designates an orifice plate made of the resin film; 405 designates an ejection outlet formed in the orifice plate 404. FIG. 5 is a sectional view taken along line A—A' in FIG. 4. In FIG. 5, a reference numeral 505 designates an ink passages communicating with the opening 403; 506 designates an energy generating element for generating energy contributable to ejection of the liquid through the ejection outlets 405, such as an electrothermal transducer element.

When the ejection outlet is formed by an excimer laser applied at the front side of the orifice plate, as shown in FIG. 3, the configuration of the ejection outlet is such that it is diverging in the direction of ejection of ink droplet.

In the case of such a diverging configuration with paper, the liquid ejection speed is decreased in cases resulting in degradation of print quality.

(2) It is considered that an ultraviolet laser beam is applied from the inside, more particularly, to a member having a top plate with recesses constituting the ink passages and an ejection outlet member in which the ejection outlets (orifices) are formed, from the recess side.

This is shown in FIG. 6 wherein an ultraviolet laser beam is applied from the ink passage side to the integral top plate and orifice plate. In this Figure, a reference numeral 601 designates a laser oscillator for generating an ultraviolet laser beam; 602 designates a laser beam generated by the laser oscillator 601; 603*a*, 603*b* and 603*c* designate optical elements constituting a lens system; 604 is a projection mask on which material such as aluminum capable of blocking the laser beam 602 is evaporated.

FIG. 7 is a sectional view of a top plate in which the orifices are formed through this process. In this Figure, a reference numeral 701 designates an orifice plate integral with the top plate 703; 704 designates a center line of the orifice 702 formed by the laser beam. The center line is inclined because the laser beam is inclined relative to the top plate.

By the orifice forming process shown in FIG. 6, the resultant orifice has a reversed taper converging in the direction of the liquid ejection. In the ink jet recording head having such an orifice, the ejection speed at the time of recording is stabilized.

The usual configuration of the ink passage formed by coupling a base plate and a top plate has a rectangular configuration, with which the ink movement is relatively stable so that the ejection and the refilling actions are smooth. However, if an attempt is made to form a large size orifice to enhance the ink ejection characteristics, the laser beam having passed through the mask is shaded by the wall constituting the ink passage with the result of formation of a small diameter orifice or deformed orifice.

This is shown in FIG. 15, wherein reference numeral 1502 designates a top plate having grooves constituting the ink passages; 1504 designates an orifice plate integrally mounted on the top plate; 1501 is a laser beam passed through the mask and focused on the plane of the orifice; and 1502 designates a passage wall defining the ink passage 1503. As will be understood from FIG. 15, if an attempt is made to form a large diameter orifice for the purpose of enhancing the ink ejection characteristics, the part of the laser beam is shaded by the passage wall 1502 constituting the ink passage, as indicated by the hatching. When the beam is shaded at the entrance side by the passage wall 1502, the ejection outlet (orifice) formed in the orifice plate 1504 is no longer circular, and the diameter becomes smaller. If the orifice having such a small diameter and having a deformed configuration is used in an ink jet recording head, the quantity of the liquid in an ink droplet is not proper for the image recording; the direction of the ejected ink is not stable.

SUMMARY OF THE INVENTION

Accordingly, it is a principal object of the present invention to provide an ink jet recording head, cartridge and apparatus wherein a laser beam is not shaded by the liquid passage thereof so that properly shaped orifices can be formed.

It is another object of the present invention to provide an ink jet recording head, cartridge and apparatus wherein an ink droplet will have a sufficient quantity for proper recording.

It is a further object of the present invention to provide an ink jet recording head, cartridge and an apparatus wherein the direction of the ink ejection is stabilized.

It is a further object of the present invention to provide an ink jet recording head, a unit and apparatus wherein the ink passage has a trapezoidal cross-section.

It is a further object of the present invention to provide an ink jet recording head, unit and apparatus wherein the ink flow in the small size portion of the ink passage can be utilized at a maximum.

It is a further object of the present invention to provide an ink jet recording head, cartridge and apparatus wherein ink ejections are uniform with stabilized ink ejection direction.

It is a further object of the present invention to provide an ink jet head, cartridge and apparatus wherein the quantity of an ink droplet required for the recording is assured without variation in the resistance against the ink liquid flow, thus stabilizing good image forming operation.

It is a further object of the present invention to provide an ink jet head, cartridge and apparatus having an ink passage having a trapezoidal cross-section in the direction perpendicular to the direction of the ink ejection.

It is a further object of the present invention to provide an ink jet head, cartridge and apparatus having an ink passage having a hexagonal cross-section.

According to an aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein said ink passage has a trapezoidal cross-section.

According to another aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein a configuration of said ejection outlet has a similarity with a configuration of a cross-section of the ink passage in a direction perpendicular to a direction of flow of the ink, and wherein an area of the ejection outlet is not less than 35% and not more than 60% of a cross-sectional area of the ink passage.

According to a further aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein said ink passage has a trapezoidal cross-section in the direction perpendicular to a direction of the ejection of the ink, and wherein the ejection outlet has a trapezoidal configuration having a similarity with a configuration of a cross-section of the ink passage.

According to a further aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein said ink passage has a trapezoidal cross-section in the direction perpendicular to a direction of the ejection of the ink, and wherein the ejection outlet has a trapezoidal configuration having a similarity with a configuration of a cross-section of the ink passage, wherein the ejection outlet is formed by a laser beam.

According to a further aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein a configuration of said ejection outlet has a similarity with a configuration of a cross-section of the ink passage in a direction perpendicular to a direction of flow of the ink, and wherein an area of the ejection outlet is not less than 35% and not more than 60% of a cross-sectional area of the ink passage, wherein the ejection outlet is formed by a laser beam.

According to a further aspect of the present invention, there is provided an ink jet head, comprising: a first member provided with an ejection energy generating element for generating energy contributable to ejection of ink; a second member provided with a recess for defining a ink passage by being coupled with said first member, corresponding to said ejection energy generating element; a third member provided with an ejection outlet which communicates with the ink passage and through which the ink is ejected; wherein a configuration of the ejection outlet is polygonal shape having rotational similarity and having 2n corners ($n \geqq 3$).

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
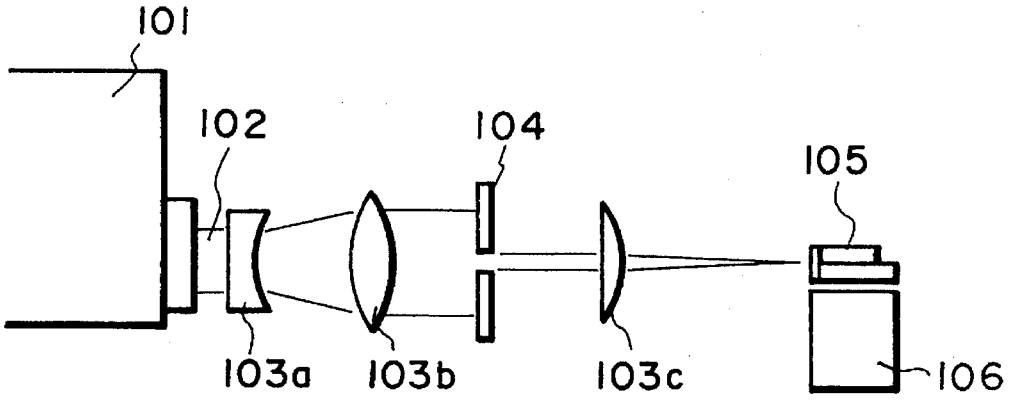
FIGS. 1, 3 and 6 illustrate conventional laser machining processes.
Figure 2:
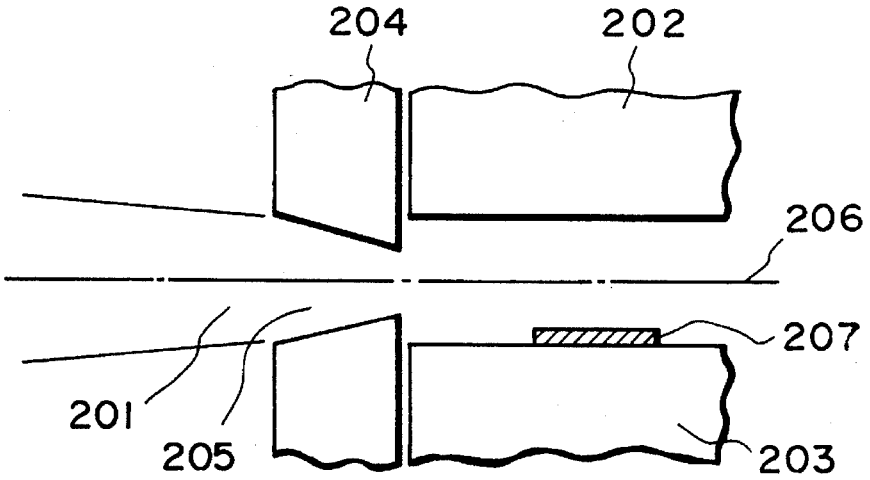
FIGS. 2, 5 and 7 are schematic sectional views illustrating the configurations of the ejection outlets of the ink jet recording heads produced through the process shown in FIG. 1, through the process shown in FIG. 3 and through the process shown in FIG. 6, respectively.
Figure 3:
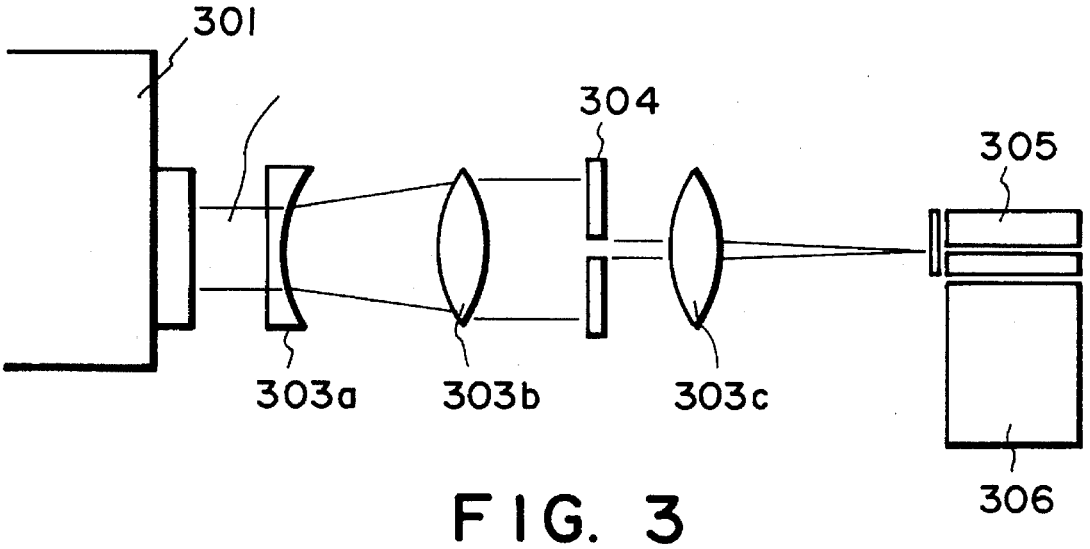
Figure 4:
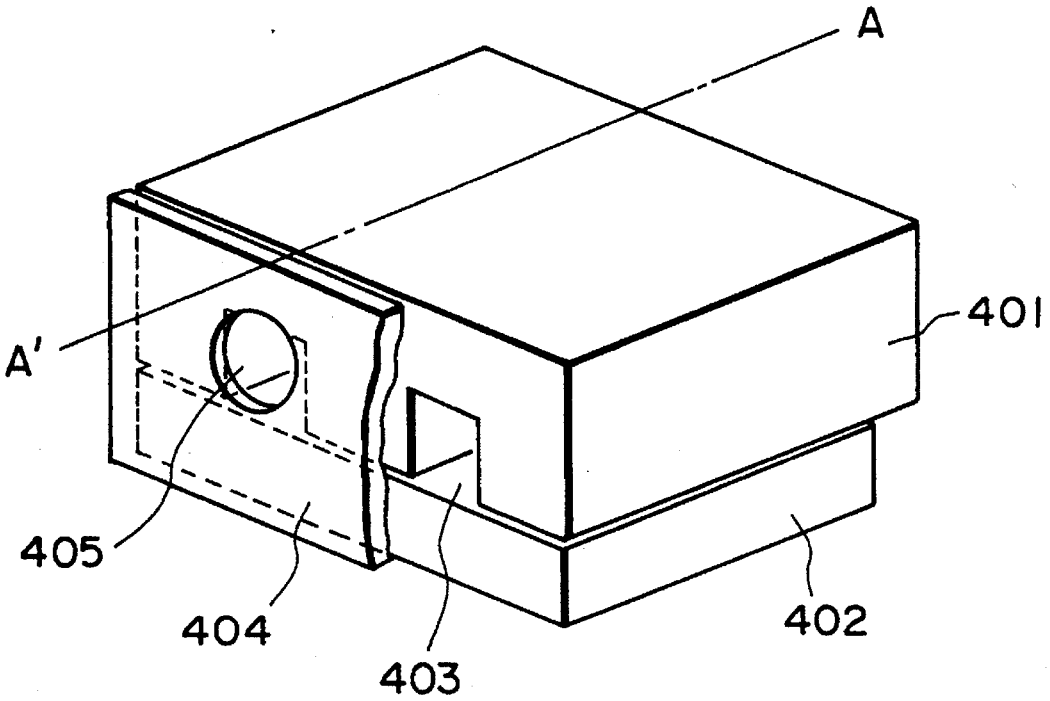
FIG. 4 is a perspective view of a recording head produced by a conventional laser process.
Figure 5:
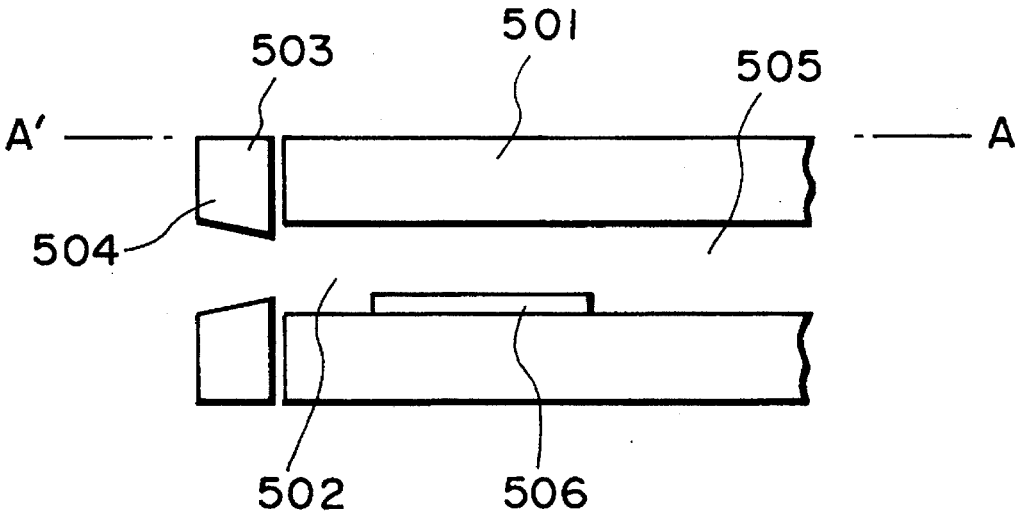
Figure 6:
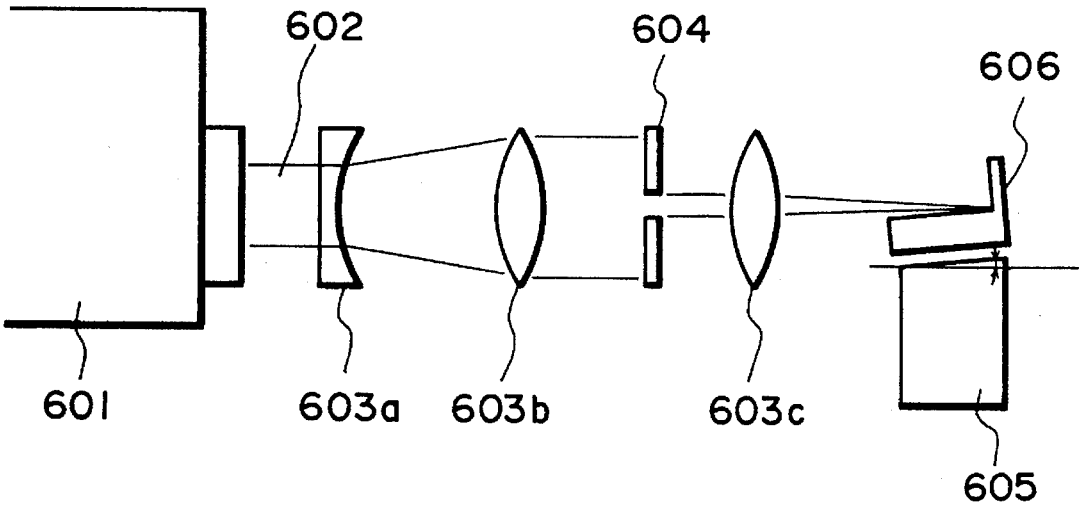
Figure 7:
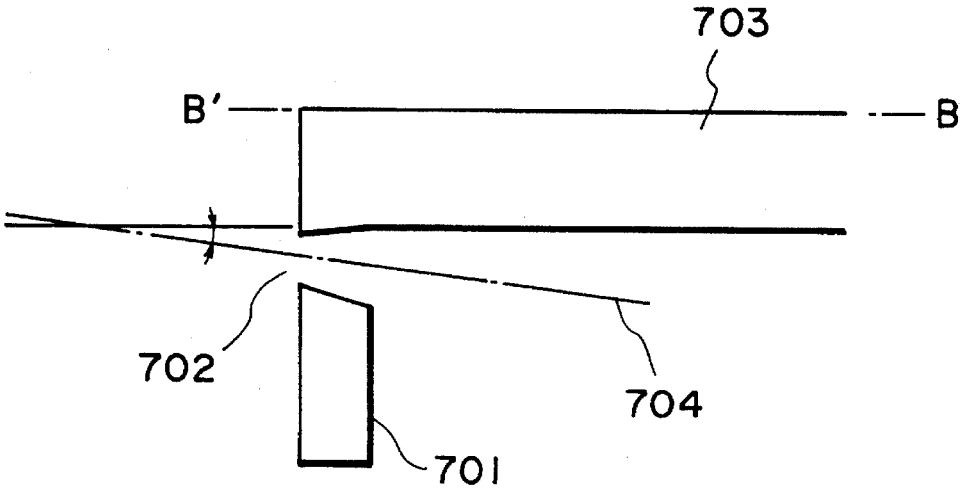
Figure 8:
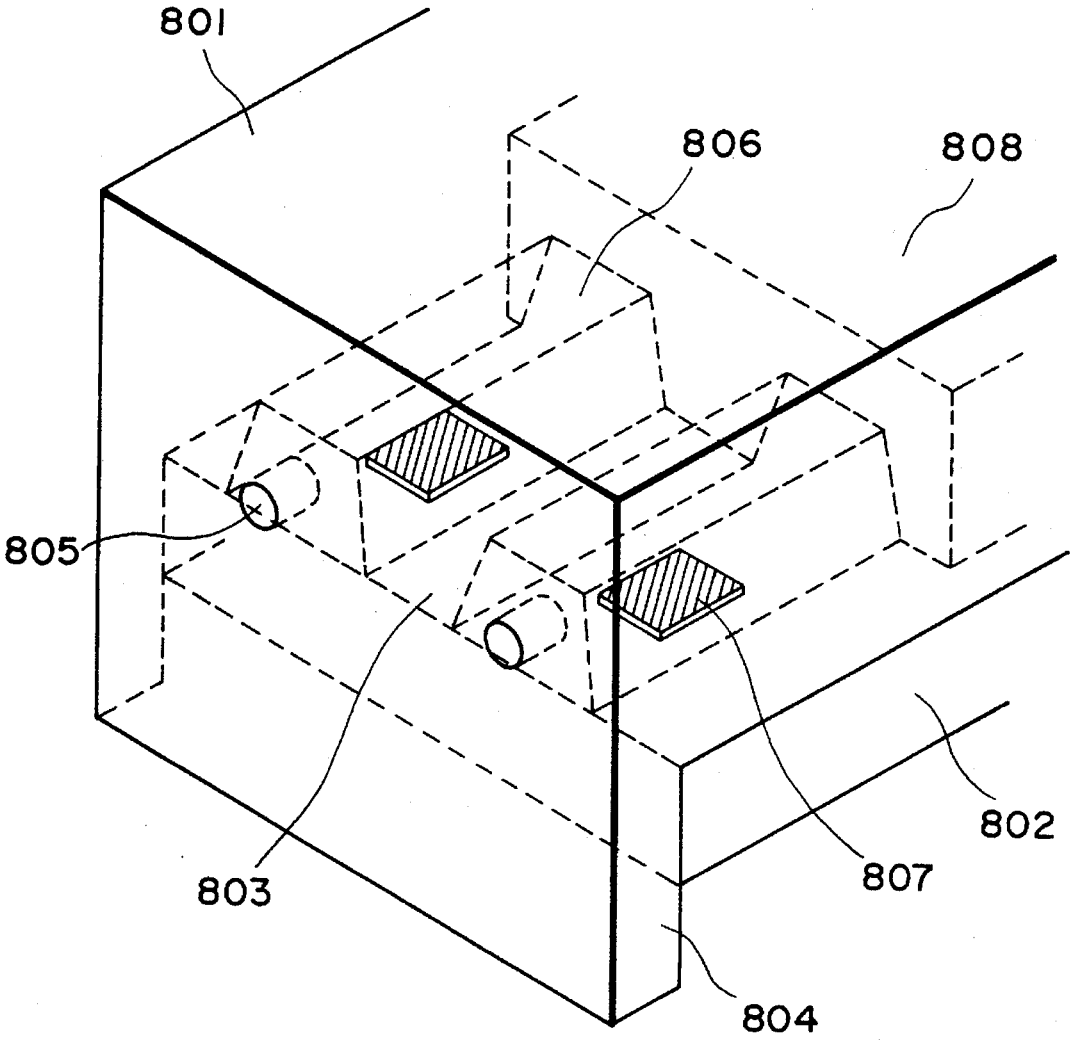
FIG. 8 is a perspective view of an ink jet recording head according to a first embodiment of the present invention.

Referring to FIG. 8, there is shown a major portion of an ink jet recording head according to a first embodiment of the present invention. In this embodiment, the laser generator used is the same as shown in FIG. 6 in which the laser beam is applied from the inside of the recording head. The ultraviolet laser source is in the form of an excimer laser oscillator (KrF). The excimer laser generator produces a laser beam having a wavelength of 248 mm in the form of pulses having a pulse width of approximately 15 nsec when it is used for the formation of the orifice. The lens system is made of synthesized quartz coated with anti-reflection material. The projection mask has a pattern made by aluminum which is capable of blocking the KrF laser beam. The aluminum is evaporated.

The top plate 801 comprises ink passage grooves 806, ink ejection outlets (orifices) 805 formed in the orifice plate 804. The number thereof may be determined as desired. In the Figure only two of them are shown for the same of simplicity. The orifice plate 804 is integral with the top plate 801.

In FIG. 8, the top plate 801 is made of polysulfon or polyether sulfon, polyphenylene oxide or polypropylene resin exhibiting good resistivity against the ink, and the top plate 801 is integrally and simultaneously molded with the orifice plate 804 in a mold.

The description will be made as to the method of forming the orifice 805 and the ink passage groove 806.

The grooves 806 may be molded using a mold having an opposite pattern produced by machining. By doing so, the grooves 806 are easily formed in the top plate 801. The cross-section of the ink passage in the direction perpendicular to the ink ejection direction in this embodiment is such that it gradually increases toward the junction between the top plate and a base plate to be coupled therewith.

In the mold, the orifice plate is formed without the orifice 805. As has been described in conjunction with FIG. 6, an excimer laser beam from the laser oscillator is projected from the ink liquid passage side of the orifice plate 804 at a position where the orifice 805 is to be formed. By the projection thereof, the resin is removed and/or evaporated, so that an orifice 805 is formed.

Figure 14:
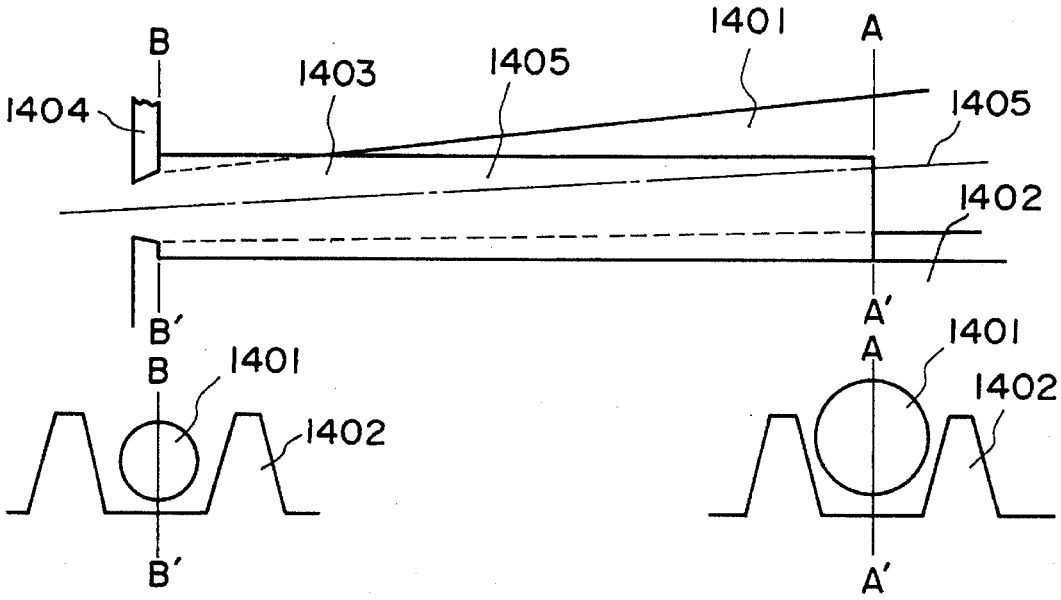
FIGS. 14 and 15 illustrates the manufacturing process using a laser beam according to an embodiment of the present invention.
Figure 15:
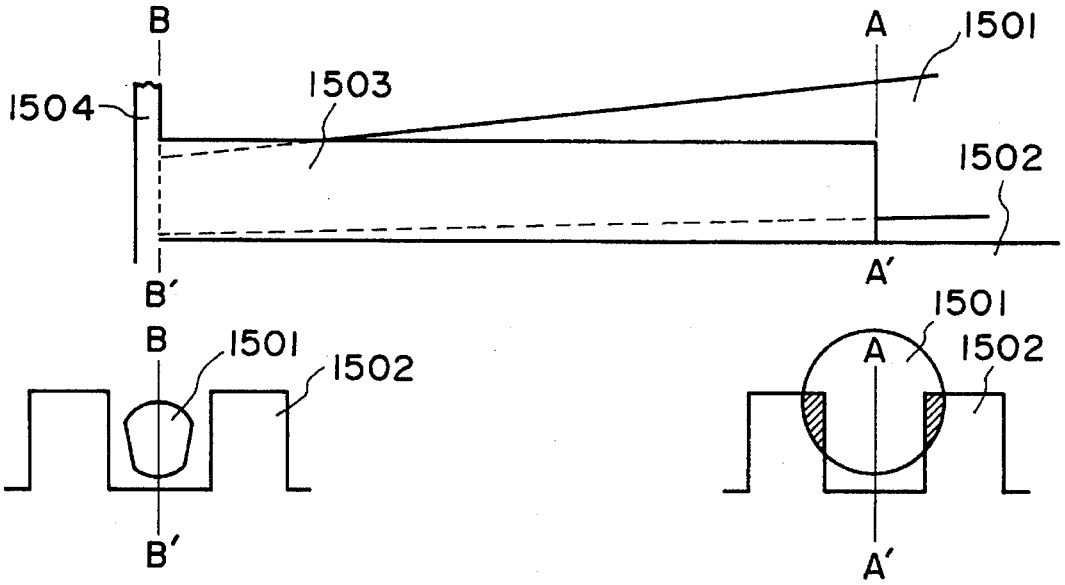

FIG. 14 shows the details of the orifice formation. As will be understood from this Figure, the excimer laser beam 1401 is projected to the orifice plate 1404 from the ink passage 1405 side through the mask, and is focused on the orifice plate 1404. The excimer laser beam 1401 is converted toward the optical axis 1405 with an angle of 2 degrees at one side (θ1). The optical axis 1405 of the laser beam is inclined relative to the direction perpendicular to the orifice plate 1400 surface by 5 degrees (= θ2). In the case of the ink jet recording head of FIG. 8, the cross-section of the ink passage is trapezoidal, and therefore, the laser beam is not shaded by the ink flow passage wall 1403 even if the laser beam is projected from the inside of the recording head, for the purpose of providing a large diameter ejection outlet (orifice). Therefore, the configuration of the orifice is not deformed, and the cross-section converges in the direction of the ejection.

An excimer laser beam used in this embodiment will be described. The excimer laser is capable of oscillating ultraviolet light. The beam generated thereby has high energy; the band width is small; the directivity is good; a short pulse oscillation is possible; the beam can be converged using a lens to increase the energy density. They are all advantageous the excimer laser oscillator effect discharge and excitation of a mixture of rare gas and halogen, by which ultraviolet light is oscillated in the form of short pulses (15–35 ns). As for the gas, Kr-F, Xc= Cl or Ar-F laser are used widely. The oscillation energy has several hundreds mJ/pulse, and the frequency of the pulses is 30–1000 Hz.

When the polymer resin surface is exposed to the short pulse ultraviolet light having high energy such as an excimer laser beam, the exposed portion is instantaneously dissolved and scattered together with plasma emission and impact noise (abrative photodecomposition) (APD). Thus, the polymer resin can be processed.

The comparison will be made between the machining accuracy by the excimer laser and that by the other laser. For example, a polyimide (PI) film is exposed to the excimer laser and to YAG laser and $CO_2$ laser. A clear opening is formed by the KrF laser since the polyimide absorbs ultraviolet region wavelength light. However, with the YAG laser, an opening is formed, but the edge is not smooth since the laser does not have the bandwidth in the ultraviolet region. The $CO_2$ laser producing infrared light produces a hole, but with a crater therearound. The metal such as stainless steel, non-transparent ceramics and Si or the like are not influenced by the excimer laser in the atmospheric ambience, and therefore, they are usable as the material for the mask.

In the foregoing structure, the positioning and bonding between the top plate and the orifice plate are not required, and therefore, the positional error at the time of the bonding can be avoided. This reduces the number of rejects, and the number of manufacturing steps can be reduced. This is contributable to the mass-production and the low cost of the recording head. In addition, the lack of the bonding step between the top plate and the orifice plate has eliminated the liability of the clogging of the orifices and the ink passages by the bonding material flowing thereinto. Upon the bonding between the heater board 802 and the top plate 801 having the integral orifice plate 804, the positioning therebetween is possible by abutting the heater board 802 to the end surface opposite from the ejection side surface of the orifice plate 804, and therefore, the entire positioning step and the assembling steps are made easier. In addition, the orifice plate is not separated unintentionally.

FIGS. 9, 10, 11, 12 and 13 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 9:
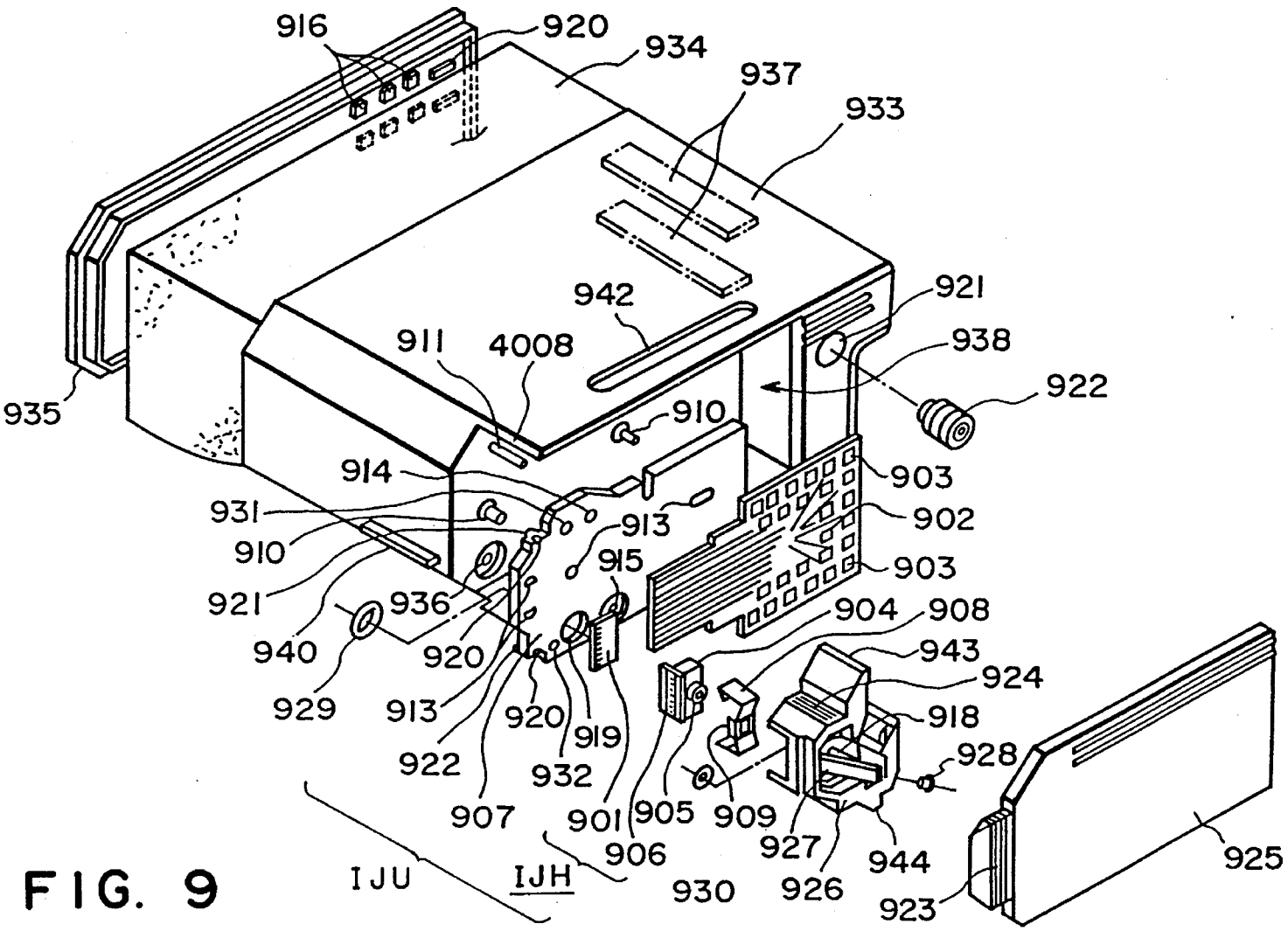
FIGS. 9, 10, 11, 12 and 13 illustrate an ink jet recording apparatus using the recording head according to the present invention.
Figure 10:
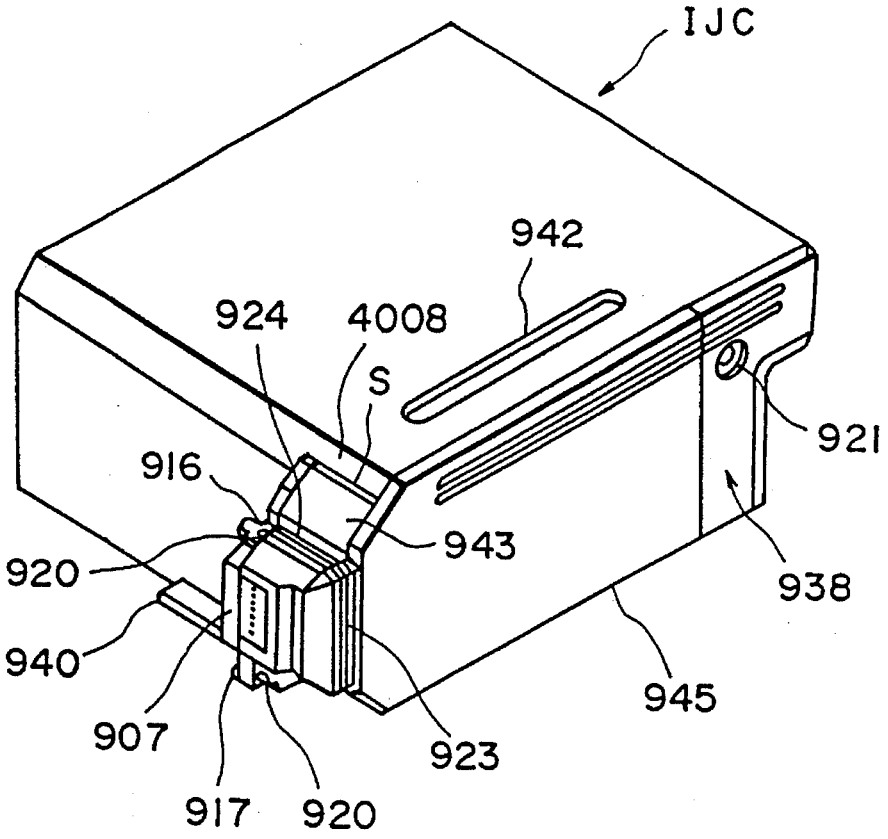

As will be understood from the perspective view of FIG. 10, the ink jet cartridge IJC in this embodiment has a relatively large ink accommodation space, and an end portion of the ink jet unit IJU is slightly projected from the front side surface of the ink container IT. The ink jet cartridge IJC is mountable at the correct position on the carriage HC (FIG. 12) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 9–13 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 9, the unit comprises a heater board 901 having electrothermal transducers (ejection heaters) arranged in a line on an Si substrate and electric lead lines made of aluminum or the like to supply electric power thereto. The electrothermal transducer and the electric leads are formed by a film forming process. A wiring board 902 is associated with the heater board 901 and includes wiring corresponding to the wiring of the heater board 901 (connected by the wire bonding technique, for example) and pads 903 disposed at an end of the wiring to receive electric signals from the main assembly of the recording apparatus.

A top plate 904 is provided with grooves which define partition walls for separating adjacent ink passages and a common liquid chamber for accommodating the ink to be supplied to the respective ink passages. The top plate 904 is formed integrally with an ink jet opening 905 for receiving the ink supplied from the ink container IT and directing the ink to the common chamber, and also with an orifice plate 906 having the plurality of ejection outlets corresponding to the ink passages. The material of the integral mold is preferably polysulfone, but may be another molding resin material.

A supporting member 907 is made of metal, for example, and functions to support a backside of the wiring board 902 in a plane, and constitutes a bottom plate of the ink jet unit IJU. A confining spring 908 is in the form of an "M" having a central portion urging to the common chamber with a light pressure, and a clamp 909 urges concentratedly with a line pressure to a part of the liquid passage, preferably the part in the neighborhood of the ejection outlets. The confining spring 908 has legs for clamping the heater board 901 and the top plate 904 by penetrating through the openings 913 of the supporting plate 907 and engaging the back surface of the supporting plate 907. Thus, the heater board 901 and the top plate 907 are clamped by the concentrated urging force by the legs and the clamp 909 of the spring 908. The supporting plate 907 has positioning openings 913, 914 and 915 engageable with two positioning projections 910 and positioning and fuse-fixing projections 911 and 912 of the ink container IT. It further includes projections 916 and 917 at its backside for the positioning relative to the carriage HC of the main assembly IJRA.

In addition, the supporting member 907 has a hole 320 through which an ink supply pipe 918, which will be described hereinafter, is penetrated for supplying ink from the ink container. The wiring board 902 is mounted on the supporting member 907 by bonding agent or the like. The supporting member 907 is provided with recesses 920 and 920 adjacent the positioning projections 917 and 917.

Figure 12:
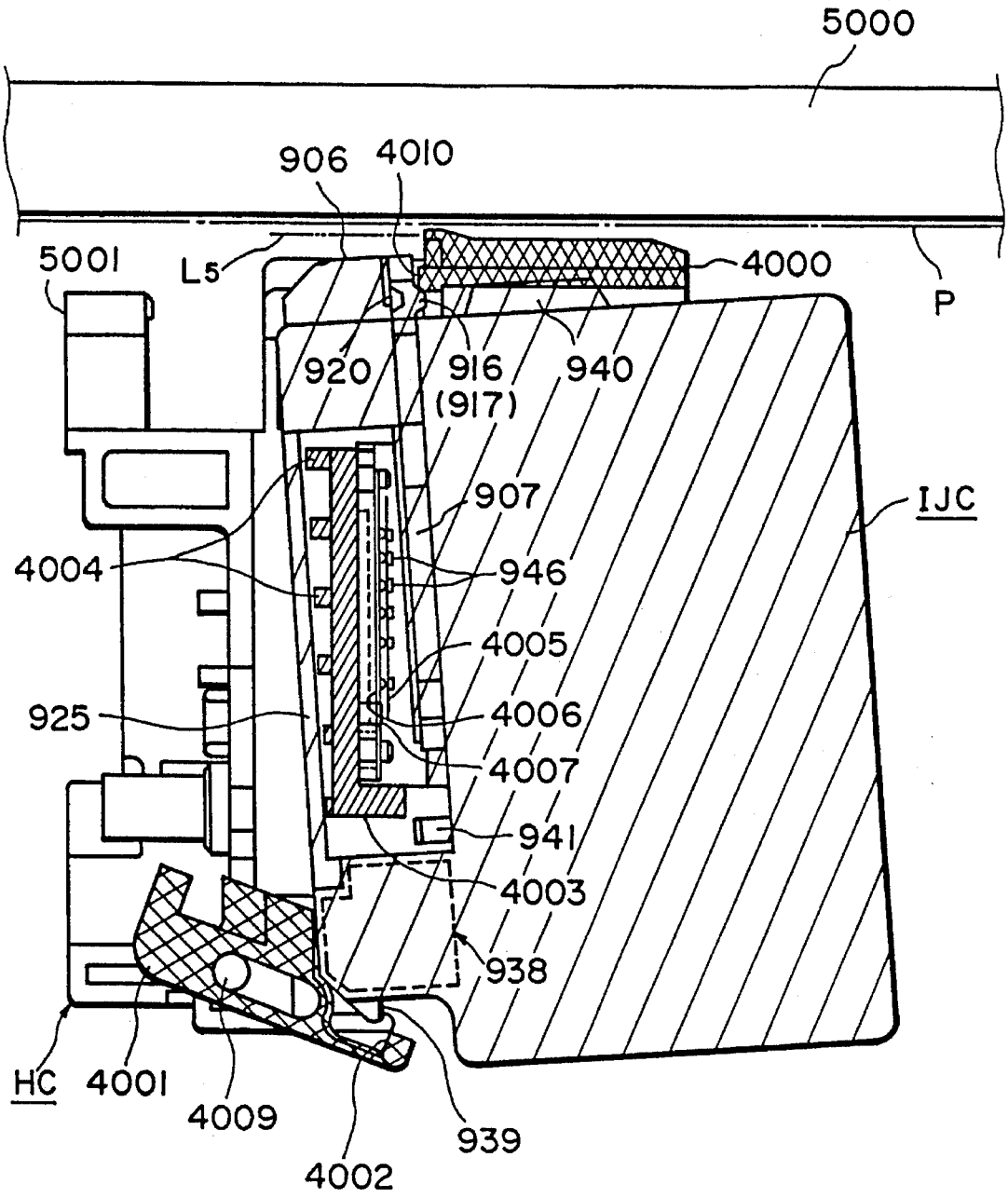

As shown in FIG. 10, the assembled ink jet cartridge IJC has a head projected portion having three sides provided with plural parallel grooves 923 and 924. The recesses 920 and 920 are located at extensions of the parallel grooves at the top and bottom sides to prevent the ink or foreign matter moving along the groove from reaching the projections 916 and 917. The covering member 925 having the parallel grooves 923, as shown in FIG. 12, constitutes an outer casing of the ink jet cartridge IJC and cooperates with the ink container to define a space for accommodating the ink jet unit IJU. The ink supply member 926 having the parallel groove 924 has an ink conduit pipe 927 communicating with the above-described ink supply pipe 918 and cantilevered at the supply pipe 918 side. In order to assure the capillary action at the fixed side of the ink conduit pipe 927 and the ink supply pipe 918, a sealing pin 928 is inserted.

A gasket 929 seals the connecting portion between the ink container IT and the supply pipe 918. A filter 930 is disposed at the container side end of the supply pipe. The ink supply member 926 is molded, and therefore, it is produced at low cost with high positional accuracy. In addition, the cantilevered structure of the conduit 927 assures the press-contact between the conduit 927 and the ink inlet 905 even if the ink supply member 926 is mass-produced.

In this embodiment, the complete communicating state can be assuredly obtained simply by flowing sealing bonding agent from the ink supply member side under the press-contact state. The ink supply member 926 may be fixed to the supporting member 907 by inserting and penetrating backside pins (not shown) of the ink supply member 926 through the openings 931 and 932 of the supporting member 907 and by heat-fusing the portion where the pins are projected through the backside of the supporting member 907. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 933, an ink absorbing material and a cover member 935. The ink absorbing material 934 is inserted into the main body 933 from the side opposite from the unit (IJU) mounting side, and thereafter, the cover member 935 seals the main body.

The ink absorbing material 934 is thus disposed in the main body 933. The ink supply port 936 functions to supply the ink to the ink jet unit IJU comprising the above-described parts 901–906, and also functions as an ink injection inlet to permit initial ink supply to the absorbing material 901 before the unit IJU is mounted to the portion 935 of the main body.

In this embodiment, the ink may be supplied through an air vent port and this supply opening. In order to good supply of ink, ribs 937 is formed on the inside surface of the main body 933, and ribs 916 and 920 are formed on the inside of the cover member 935, which are effective to provide within the ink container an ink existing region extending continuously from the air vent port side to that corner portion of the main body which is most remote from the ink supply opening 936. Therefore, in order to uniformly distribute the ink in good order, it is preferable that the ink is supplied through the supply opening 936. This ink supply method is practically effective. The number of the ribs 937 in this embodiment is four, and the ribs 937 extend parallel to a movement direction of the carriage adjacent the rear side of the main body of the ink container, by which the absorbing material 934 is prevented from closely contacted to the inner surface of the rear side of the main body. The ribs 916 and 920 are formed on the inside surface of the cover member 935 at a position which is substantially an extension of the ribs 937, however, as contrasted to the large rib 937, the size of the ribs 916 and 920 are small as if it is divided ribs, so that the air existing space is larger with the ribs 916 and 920 than with the rib 937. The ribs 916 and 920 are distributed on the entire area of the cover member 935, and the area thereof is not more than one half of the total area. Because of the provisions of the ribs, the ink in the corner region of the ink absorbing material which is most remote from the supply opening 926 can be stably and assuredly supplied to the inlet opening by capillary action. The cartridge is provided with an air vent port for communication between the inside of the cartridge with the outside air. Inside the vent port 922, there is a water repellent material 922 to prevent the inside ink from leaking outside through the vent port 922.

The ink accommodating space in the ink container IT is substantially a rectangular parallelepiped in configuration, with the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 935 to stabilize the ink supply from the ink absorbing material 933. The cube configuration is preferable from the standpoint of accommodating as much as possible ink in limited space. However, from the standpoint of using the ink with minimum an available part in the ink container, the provisions of the ribs formed on the two surfaces constituting a corner.

In this embodiment, the inside ribs 916 and 920 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 936 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 921. The inside of the projection is substantially vacant, and the vacant space 938 functions to supply the air into the ink container IT uniformly in the direction of the thickness of the absorbing material. Because of these features described above, the cartridge as a whole is of better performance than the conventional cartridge. The air supply space 938 is much larger than that in the conventional cartridge. In addition, the air vent port 921 is at an upper position, and therefore, if the ink departs from the absorbing material for some reason or another, the air supply space 938 can tentatively retain the ink to permit such ink to be absorbed back into the absorbing material. Therefore, the wasteful consumption of the ink can be saved.

Figure 11:
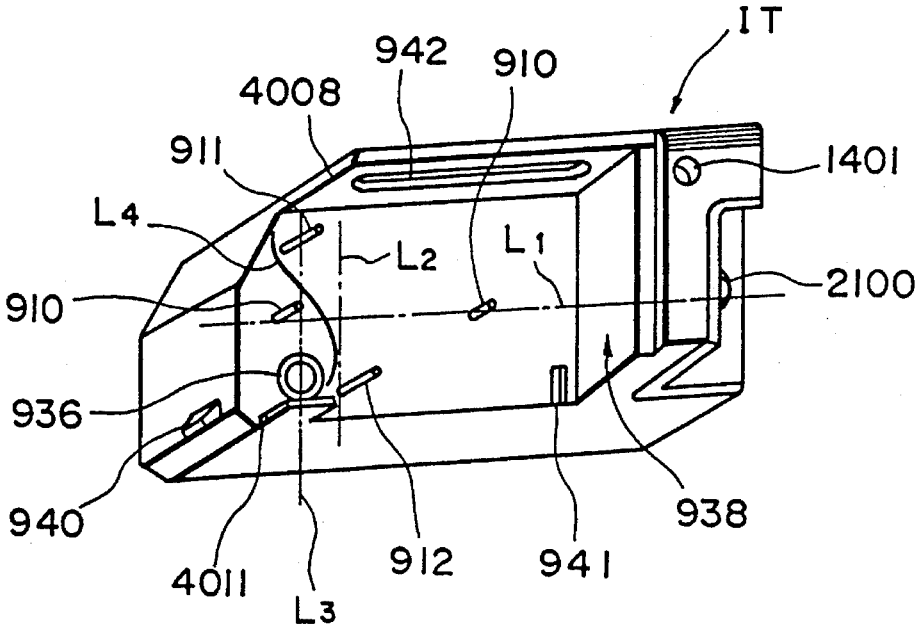

Referring to FIG. 11, there is shown a structure of a surface of the ink container IT to which the unit IJU is mounted. Two positioning projections 910 are on a line L1 which is a line passing through the substantial center of the array of the ejection outlets in the orifice plate 906 and parallel with the bottom surface of the ink container IT or the parallel to the ink container supporting reference surface of the carriage. The height of the projections 910 is slightly smaller than the thickness of the supporting member 907, and the projections 910 function to correctly position the supporting member 907. On an extension (right side) in this Figure, there is a pawl 939 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 12.

Projections 911 and 912 corresponding to the fixing holes 914 and 915 for fixing the supporting member 907 to the side of the ink container IT, are longer than the projections 910, so that they penetrate through the supporting member 907, and the projected portions are fused to fix the supporting member 907 to the side surface. A line L3 passing through the projection 911 and perpendicular to the line L1, and a line L2 passing through the projection 912 and perpendicular to the line L1, are drawn. The center of the supply opening 936 is substantially on the line L3, the connection between the supply opening 936 and a supply type 918 is stabilized, and therefore, even if the cartridge falls, or even if a shock is imparted to the cartridge, the force applied to the connecting portion can be minimized. In addition, since the lines L2 and L3 are not overlapped, and since the projections 911 and 912 are disposed adjacent to that projection 910 which is nearer to the ink ejection outlets of the ink jet head, the positioning of the ink jet unit relative to the ink container is further improved. In this Figure, a curve L4 indicates the position of the outer wall of the ink supply member 926 when it is mounted. Since the projections 911 and 912 are along the curve L4, the projections are effective to provide sufficient mechanical strength and positional accuracy against the weight of the end structure of the head IJH.

An end projection 940 of the ink container IT is engageable with a hole formed in the front plate 4000 of the carriage to prevent the ink cartridge from being displaced extremely out of the position. A stopper 941 is engageable with an unshown rod of the carriage HC, and when the cartridge IJC is correctly mounted with rotation, which will be described hereinafter, the stopper 941 take a position below the rod, so that even if an upward force tending to disengage the cartridge from the correct position is unnecessarily applied, the correct mounted state is maintained. The ink container IT is covered with a cover 925 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 942 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 926 through a supply opening 936, the hole 919 of the supporting member 907 and an inlet formed in the backside of the ink supply member 926. From the chamber of the ink supply member 926, the ink is supplied to the common chamber through the outlet, supply pipe and an ink inlet 905 formed in the top plate 904. The connecting portion for the ink communication is sealed by silicone rubber or butyl rubber or the like to assure the hermetical seal.

In this embodiment, the top plate 904 is made of resin material having resistivity to the ink, such as polysulfone, polyether sulfone, polyphenylene oxide, polypropylene. It is integrally molded in a mold together with an orifice plate portion 906.

As described in the foregoing, the integral part comprises the ink supply member 926, the top plate 904, the orifice plate 906 and parts integral therewith, and the ink container body 933. Therefore, the accuracy in the assembling is improved, and is convenient in the mass-production. The number of parts is smaller than inconventional device, so that the good performance can be assured.

In this embodiment, as shown in FIGS. 9– 11, the configuration after assembly is such that the top portion 943 of the ink supply member 926 cooperates with an end of the top thereof having the slits 942, so as to form a slit S, as shown in FIG. 10. The bottom portion 944 cooperates with fed side end 4011 of a thin plate to which the bottom cover 925 of the ink container IT is bonded, so as to form a slit (not shown) similar to the slit S. The slits between the ink container IT and the ink supply member 926 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink Jet Cartridge IJC to the Carriage HC

In FIG. 12, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 906 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 946 corresponding to the pads 903 of the wiring board 902 of the ink jet cartridge IJC and a rubber pad sheet 4007 for producing elastic force for urging the backside of the flexible sheet 4005 to the pads 903. The positioning hook 4001 functions to fix the ink jet cartridge IJC to the recording position. The front plate 4000 is provided with two positioning projection surfaces 4010 corresponding to the positioning projections 916 and 917 of the supporting member 907 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decreases from the plate roller side to the hook 4001 side. By this, the cartridge is inclined as shown in FIG. 12, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 946 is determined. When the cartridge IJC is fixed at the recording position, the positioning surfaces are brought into contact with the surface of the supporting member 907. In this embodiment, the pads 903 of the supporting member 907 are distributed so that they are symmetrical with respect to the above-described line L1, and therefore, the amount of deformation of the respective projections of the rubber sheet 4007 are made uniform to stabilize the contact pressure of the pads 946 and 903. In this embodiment, the pads 903 are arranged in two columns and upper and bottom two rows.

The hook 4001 is provided with an elongated whole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 12 to the position toward the platen side, and the positioning projections 916 and 917 come to the position where they are engageable to the positioning surfaces 4010. Then, the hook 4001 is moved leftwardly, so that the hook surface 4002 is contacted to the pawl 939 of the cartridge IJC, and the ink cartridge IJC rotates about the contact between the positioning surface 916 and the positioning projection 4010 in a horizontal plane, so that the pads 903 and 946 are contacted to each other. When the hook 4001 is locked, that is retained at the fixing or locking position, by which the complete contacts are simultaneously established between the pads 903 and 946, between the positioning portions 916 and 4010, between the standing surface 4002 and the standing surface of the pawl and between the supporting member 907 and the positioning surface 4006, the cartridge IJC is completely mounted on the carriage.

(iv) General Arrangement of the Apparatus

Figure 13:
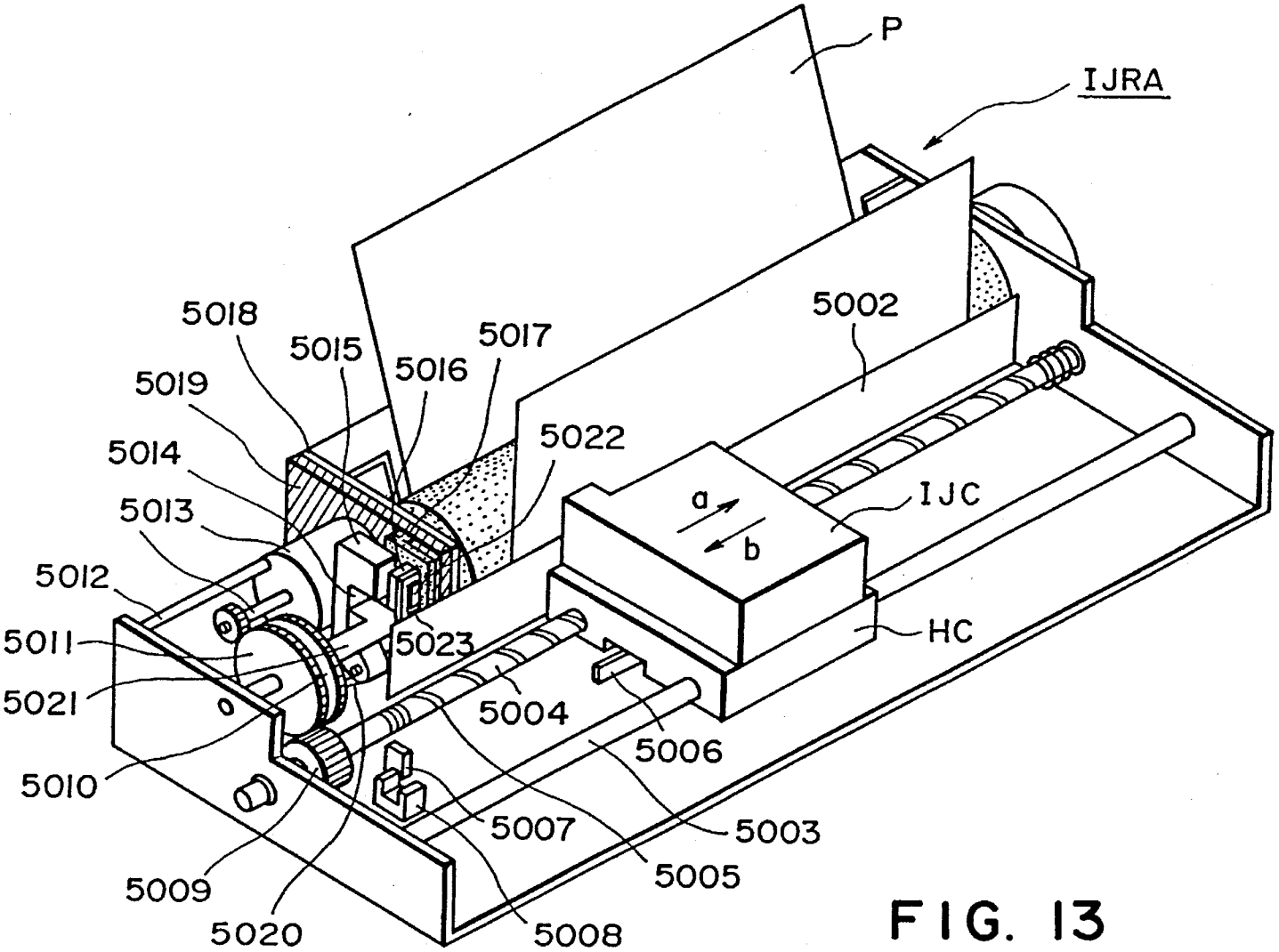

FIG. 13 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

The recording head of FIG. 8 is constructed in the form of a cartridge as shown in FIGS. 9, 10 and 11, and the cartridge is mounted on the recording apparatus of FIG. 13. It has confirmed that the ejection speed and the accuracy of the positions of the droplet on the ink is increased, and therefore, the recording has been in good order.

The volume of the ejected liquid droplet was sufficient, and therefore, the density of the print was sufficient.

Figure 16:
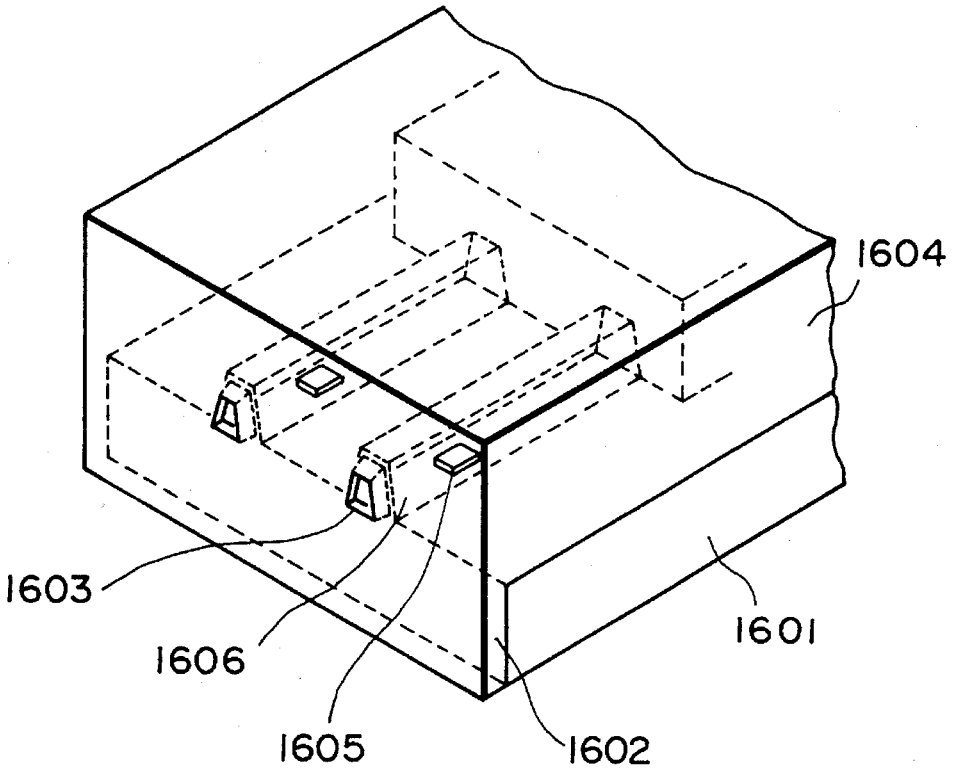
FIG. 16 is a perspective view of an ink jet recording head according to a second embodiment of the present invention.

FIG. 16 is a perspective view of a recording head according to a second embodiment of the present invention wherein a heater board 1610 is bonded with a top plate 1604.

The top plate 1604 is provided with ink passage grooves 1606 and has an orifice plate 1602 provided with an ink ejection outlets (orifices) 1603 corresponding to the grooves 1606. The number of the grooves 1606 and the orifices 1603 are determined as desired. In the Figure only two of them are shown for the sake of simplicity. The orifice plate 1602 is integral with the top plate 1604. In FIG. 16, the top plate 1604 is made of polysulfon, polyether sulfon, polyphenylene oxide or polypropylene resin which exhibits good resistivity against the ink. The top plate 1604 is molded integrally with the orifice plate 1602 simultaneously in a mold.

In this embodiment, the ink passage groove has a cross-section across the ink passage that is trapezoidal. Because of this configuration, the laser beam is not blocked or shaded by the wall of the groove even if the laser beam diameter is increased to provide a large size ejection outlet and even if the inclination angle of the laser beam relative to the ink passage. The flow of the ink is not disturbed by the trapezoidal cross-section. In addition, the contactable area between the ejection heater and the liquid is increased, and therefore, the tolerance of the deviation between the top plate and the heater board in the direction of the line of the ejection outlets can be increased when they are bonded.

Figure 17:
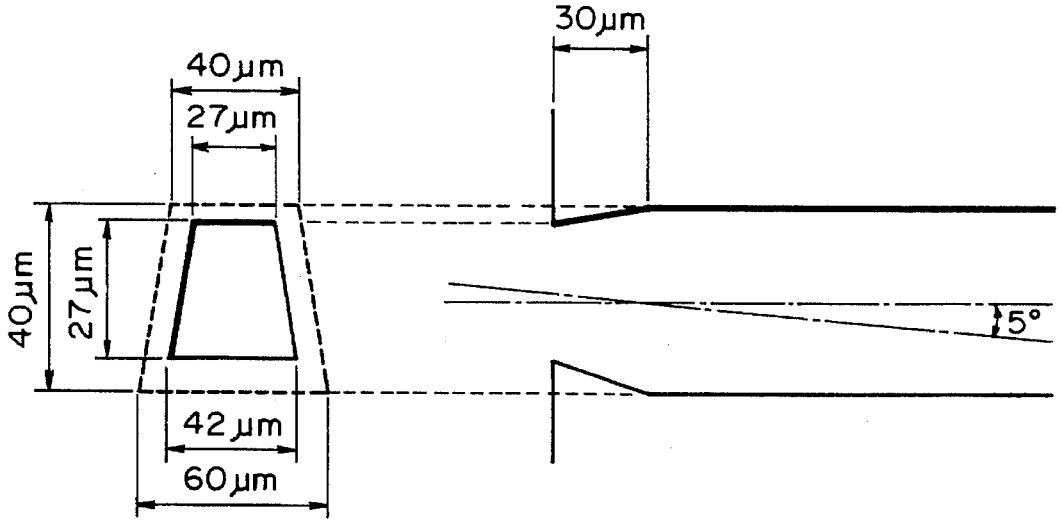
FIG. 17 illustrates the ejection outlet thereof.

The ink passage in this embodiment has a dimension of 40 microns at the top, 60 microns at the top and 60 microns of the height. The laser beam is inclined by 5 degrees relative to the ink passage. An ejection outlet having a similarity with the cross-section of the ink passage. FIG. 17 shows this example. As will be understood, when the maximum size ejection outlet is formed under the condition that the laser beam is not blocked by the wall of the ink passage, the ratio of the ejection outlet area to the ink passage area is 50% when the configuration of the ejection outlet has a similarity with the configuration of the cross-section of the ink passage. Thus, the area of the ejection outlet is approximately doubled as compared with the circular outlet (the ratio is 24%). Thus, it is possible to increase the size of the outlet up to 50% of the cross-section of the ink passage. The ink droplet can be efficiently ejected by the ejection energy.

The ratio of the ejection outlet area to the ink passage cross-sectional area, is different depending on the configuration of the ink passage. Experiments and investigations have revealed that the ratio is preferably not less than 35% and not more than 60%. In the experiments various configuration of the cross-section of the ink passages were used. If it is less than 35%, the same situation as with circular ejection outlet occurred. That is, the volume of the ejected ink droplet is not sufficient in some case. If it is larger than 60%, the area of the ink passage side of the tapered ejection outlet becomes larger than the cross-sectional area of the ink passage with the result of unstable formation of the ejection outlet. Then, the ink ejection is not stabilized.

When the ink jet recording head is assembled using the top plate 604 in which the configuration of the ejection outlet has a similarity with the cross-sectional configuration of the ink passage, the heater board having the ejection heaters 1605 or the like is abutted and bonded to the orifice plate 1602, as shown in FIG. 16.

In this case, similarly to FIG. 8, the positional alignment and bonding between the top plate and the orifice plate as in the conventional recording head are not required. The positional error or the deviation at the time of bonding can be avoided. This reduces the number of rejections, and also reduces the number of manufacturing steps. This is contributable to the advantage in the mass-production of the recording head and to lowering of the cost. In addition, since there is no bonding step for the bonding between the top plate and the orifice plate, the orifice and the ink passage are prevented from clogging by the bonding material. In addition, when the heater board 1601 is bonded with the top plate 1604 having the integral orifice plate 1602, the positioning in the direction of the liquid flow can be performed by abutting the heater board 1601 to an end surface opposite from the ejection side end surface of the orifice plate 1602, and therefore, the entire positioning step and the assembling steps are made easier. In addition, the orifice plate is not separated unintentionally.

The recording head of FIG. 16 may be constitute as a cartridge shown in FIGS. 9, 10 and 11. The recording head of FIG. 16 can be constituted into a cartridge which in turn is mounted on an ink jet printer usable with the cartridge which may be a reusable type.

The recording head of FIG. 16 is incorporated in a cartridge shown in FIGS. 9, 10 and 11, and the cartridge is mounted in the ink jet recording apparatus of FIG. 13. High density and sharp images were produced.

Figure 18:
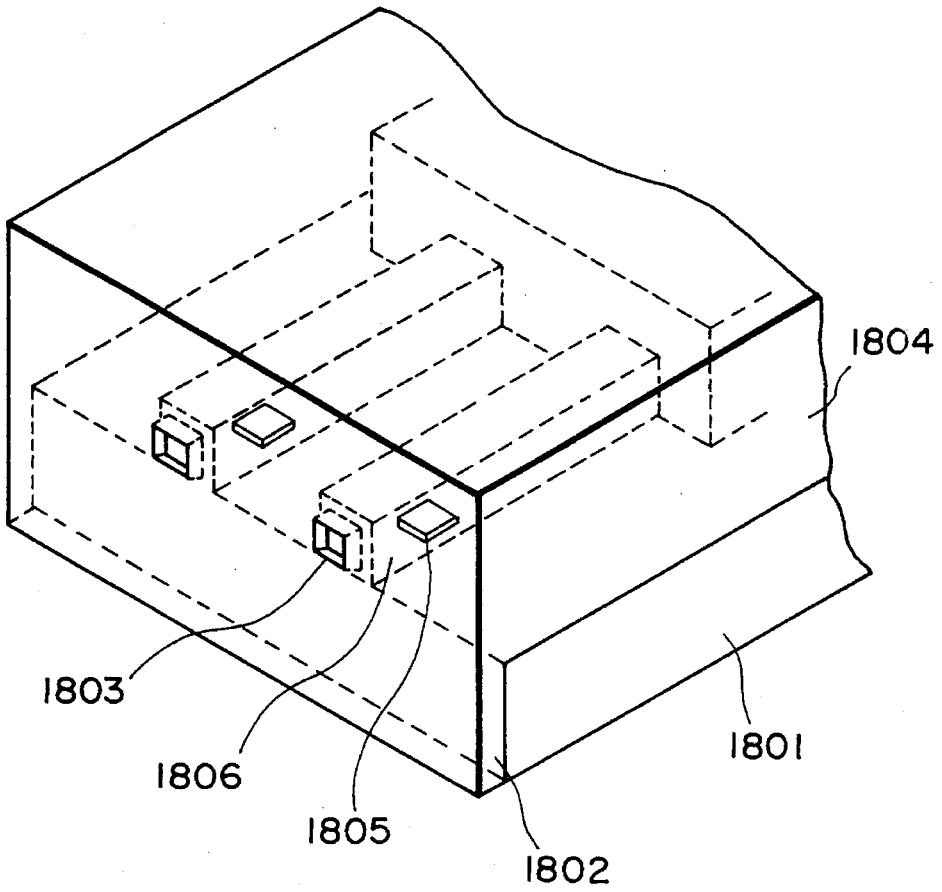
FIG. 18 is a perspective view of an ink jet recording head according to a third embodiment of the present invention.
Figure 19:
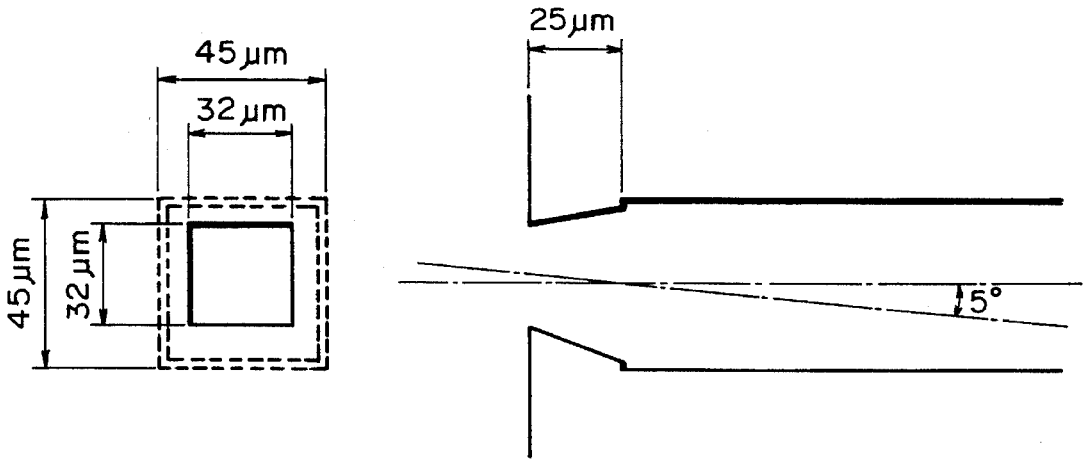
FIG. 19 illustrates an ejection outlet thereof.

Referring to FIGS. 18 and 19, a recording head according to a third embodiment of the present invention will be described. In this embodiment, the top plate 1804 is provided with ink passage grooves 1806 having a rectangular configuration and has an integral orifice plate 1802 provided with ejection outlets 1803 having the similarity with the cross-sectional configuration of the ink passage. The number of the ejection outlets and the grooves may be as desired. In the Figure only two are shown for the sake of simplicity. Similarly to the foregoing embodiments described in conjunction with FIGS. 16 and 17, the top plate 1804 was bonded with a heater board 1801 provided with heat generating resistor elements 1805, so as to constitute a recording head.

As shown in FIG. 19, the ink passage cross-section is 45 microns×45 microns, and the ejection outlet has a size of 32 microns×32 microns (similar). The ratio of the ejection outlet area to the cross-sectional area of the ink passage is 50%. Similarly to the case of the recording head of FIG. 16, the recording head is operated for the printing in the apparatus of FIG. 13. The recorded images had high density and sufficient sharpness.

Figure 20:
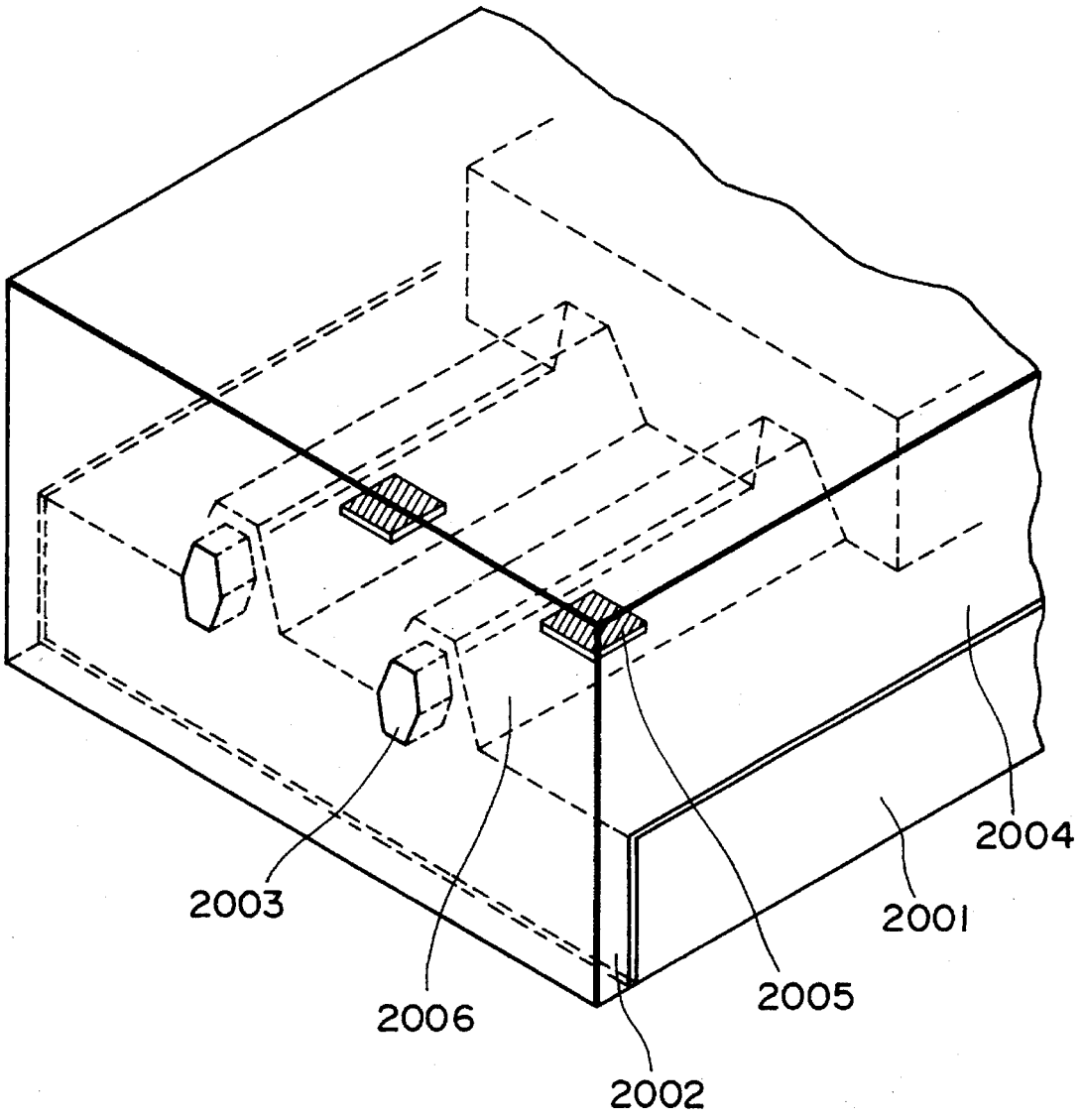
FIG. 20 is a perspective view of an ink jet recording head according to a fourth embodiment of the present invention.

FIG. 20 shows a recording head according to a fourth embodiment of the present invention wherein a heater board 2001 is bonded to a top plate 2004.

The top plate 2004 in this embodiment is provided with ink passage grooves 2006 and has an integral orifice plate 2002 provided with ink ejection outlets (orifices) 2003 corresponding to the grooves. The number of the grooves and the orifices are as desired, although only two of them are shown in the Figure for the sake of simplicity.

In the structure shown in FIG. 20, the top plate 2004 is made of polysulfone, polyethersulfon, polyphenylene oxide or polypropylene resin material which shows good resistivity against the ink. The top plate 2004 is simultaneously molded in a mold together with the orifice plate 2002.

In this embodiment, the configuration of the cross-section of the ink passage is trapezoidal. Similarly to the foregoing embodiment having the trapezoidal ink passage, this configuration is employed to prevent the laser beam being blocked by the wall of the ink passage even if the diameter of the laser beam is increased to increase the size of the ejection outlet and even if the inclination angle relative to the ink passage is reduced. The structure of such an ink passage does not impede the ink flow. The area contactable to the ejection heater can be increased, and therefore, the tolerance of the positional error in the direction of the line of the outlets, when the top plate and the heater board are bonded together. In addition, the contact area between the ink and the heater can be increased, and therefore, it is desirable.

Figure 21:
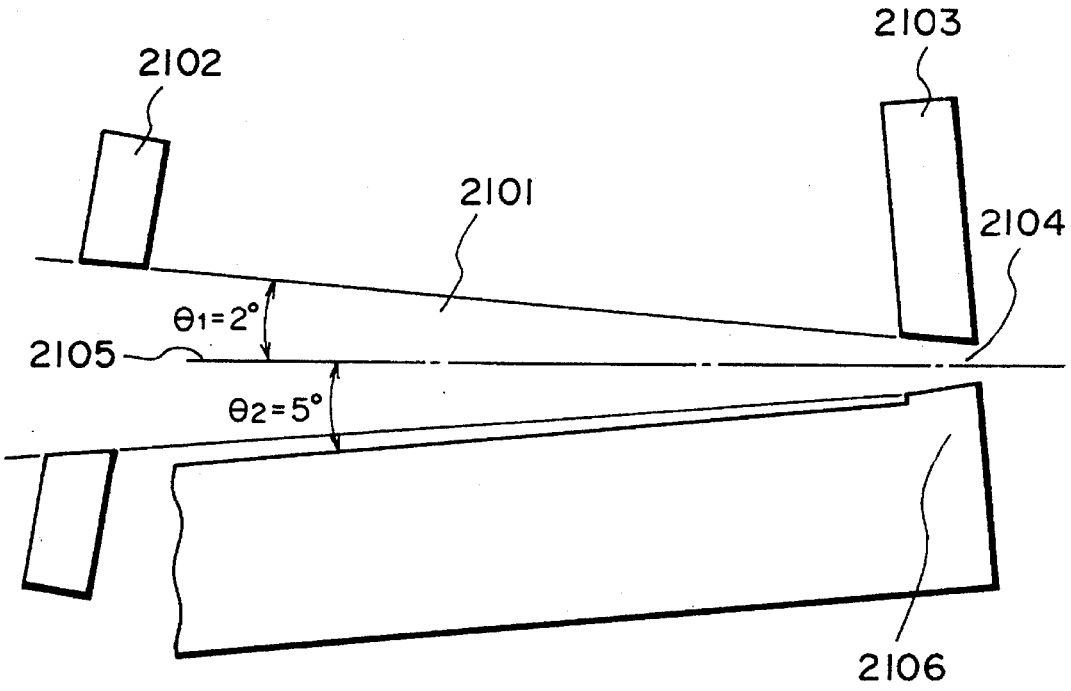
FIGS. 21 and 22 illustrate the ejection outlets thereof.
Figure 22:
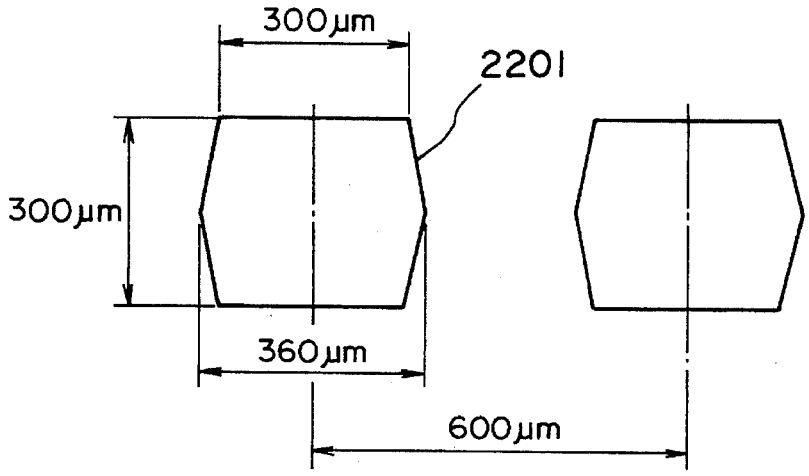

FIG. 21 shows the details of the ejection outlet formation. As shown in this Figure, the excimer laser beam 2101 is projected on the orifice plate 2103 from the backside, that is, from the ink passage 2006 side. The excimer laser beam 2101 is passed through a mask 2102 having a hexagonal transmission pattern, as shown in FIG. 22. The excimer laser beam 2101 is converted to the optical axis 2105 with an angle of 2 degrees (θ1) at one side. The laser beam is inclined by an angle of 5 degrees (θ2) relative to the optical axis 2105 relative to a direction perpendicular to the orifice plate 2103. The projection angle of the laser is not limited to the above, however in consideration of the ink ejection angle of the ejection outlet, it is preferably not less than approximately 3 degrees and not more than 20 degrees.

In this embodiment, the optical lens system reduced the mask pattern to one third size pattern. The dimensions of the ink passage is 100 microns at the top, 140 microns at the bottom and 100 microns of height (trapezoidal). The mask is in the form of a parallel plane plate made of synthetic quartz to which aluminum is evaporated to provide a hexagonal pattern 201 having $D_2h$ symmetry. The number thereof is equal to the number of orifices, although only two of them are shown for the sake of simplicity in the Figure.

When the optical system and the top plate described above is used, the maximum orifice size is provided by a mask having 300 microns diameter of the transmission area, when a circular orifice is formed. The area of the orifice provided by the mask having the hexagonal pattern described above is larger than the area formed by the circular transmission area mask by approximately 40%. When the recording head is constituted using the orifice plate having the configuration of the ejection outlet, the heater board 2001 having heat generating resistors 2005 or the like is abutted to and bonded to the orifice plate 2002 so as to provide the recording head.

Similarly to the foregoing embodiments, the conventional positioning and the bonding between the top plate and the orifice plate are not required, and therefore, the positioning error does not occur. This reduces the number of rejects, and also reduces the number of manufacturing steps. This is contributable to the improvement in the mass-production and to the lowering of the cost. Because there is no bonding step between the top plate and the orifice plate, the orifices and the ink passages are prevented from clogging by the bonding material or agent reaching thereto. Upon the bonding between the heater board 2001 and the top plate having the integral orifice plate 2002, the positioning in the direction of the passage can be accomplished by abutting the heater board 2001 to the end surface of the orifice plate 2002 opposite from the ejection side surface thereof. Therefore, the entire positioning step and the assembling steps are made easier. In addition, the orifice plate is not separated unintentionally.

The recording head may be constituted into a cartridge as shown in FIG. 9, 10 and 11. The cartridge may be of a reusable type, and may be mounted in the ink jet printer shown in FIG. 13. Actually, the printing operation was performed using the cartridge having the structure described above mounted in the printer of FIG. 13. The print was sufficiently good.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kind of recording head it may be a single head corresponding to a single color ink, or may be plural heads corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head comprising:

a first member having a thermal energy generating element for generating energy to create a bubble contributable to ejection of ink from said ink jet head;

a second member having a recess with a trapezoidal cross-section for defining an ink passage having a trapezoidal cross-section normal to a length of said recess when said second member is coupled with said first member, wherein a longer parallel side of said ink passage trapezoidal cross-section incorporates said thermal energy generating element, and wherein said second member has an ejection outlet portion with an ejection outlet through which the ink is ejected, the ejection outlet being formed at an end of said recess in liquid communication with said ink passage and having a cross-sectional area smaller than that of said ink passage.

2. An ink jet head as in claim 1, wherein said second member has a recess constituting a liquid chamber communicating with said plural ink passages.

3. An ink jet head as in claim 2, wherein said ejection outlet portion, said ink passages and said liquid chamber are disposed substantially along a straight line.

4. An ink jet head as in claim 1, wherein said first member and said second member are elastically urged together.

5. An ink jet cartridge comprising:

an ink jet head including:

a first member having a thermal energy generating element for generating energy to create a bubble contributable to ejection of ink from said ink jet head, a second member having a recess with a trapezoidal cross-section for defining an ink passage having a trapezoidal cross-section normal to a length of said recess when said second member is coupled with said first member, wherein a longer parallel side of said ink passage trapezoidal cross-section incorporates said thermal energy generating element, and wherein said second member has an ejection outlet portion with an ejection outlet through which the ink is ejected, the ejection outlet being formed at an end of said recess in liquid communication with said ink passage and having a cross-sectional area smaller than that of said ink passage; and an ink container for supplying ink to said ink jet head.

6. An ink jet recording apparatus comprising:

an ink jet cartridge including:

an ink jet head and an ink container for supplying ink to said ink jet head, said ink jet head comprising:

a first member having a thermal energy generating element for generating energy to create a bubble contributable to ejection of ink from said ink jet head;

a second member having a recess with a trapezoidal cross-section for defining an ink passage having a trapezoidal cross-section normal to a length of said recess when said second member is coupled with said first member, wherein a longer parallel side of said ink passage trapezoidal cross-section incorporates said thermal energy generating element, and wherein said second member has an ejection outlet portion with an election outlet through which the ink is elected, the ejection outlet being formed at an end of said recess in liquid communication with said ink passage and having a cross-sectional area smaller than that of said ink passage; and a carriage for carrying said cartridge, said carriage being movable for scanning a recording medium with said ink jet head.

7. An ink jet head as in claim 1, wherein said ejection outlet has an area not less than 35% and not more than 60% of an area measured at the trapezoidal cross-section of said ink passage.

8. An ink jet head as in claim 1, wherein said second member has a trapezoidal ejection outlet which communicates with said ink passage and through which the ink is ejected, and wherein each of the four sides of said trapezoidal ejection outlet is substantially parallel to respective sides of said trapezoidal cross-section of said ink passage.

9. An ink jet head as in claim 8, wherein said ejection outlet is formed by a pulsed excimer laser beam applied to the ejection outlet portion to form in the ejection outlet portion an ejection passage having a converging portion.

10. An ink jet head as in claim 1, wherein said second member has an integral ejection outlet portion of polysulfon resin having a trapezoidal ejection outlet which communicates with said ink passage and through which the ink is ejected, and wherein each of the four sides of said trapezoidal ejection outlet is substantially parallel to respective sides of said trapezoidal cross-section of said ink passage, said ejection outlet has an area not less than 35% and not more than 60% of an area measured at the trapezoidal cross-section of said ink passage.

11. An ink jet head as in claim 1, wherein said second member has a polygonal ejection outlet which communicates with said ink passage and through which the ink is ejected, and wherein said polygonal ejection outlet has rotational symmetry and 2n corners ($n \geqq 3$).

12. An ink jet head according to claim 1, wherein said ejection outlet portion functions as an abutment to which an end portion of said first member is abutted for positioning with said outlet portion.

13. An ink jet head according to claim 1, wherein said ejection outlet has an area not less than substantially 35% and not more than substantially 65% of an area measured at the cross-section of said ink passage.

14. An ink jet head according to claim 1, wherein said second member comprises at least one of polysulfon, polyethersulfon, polyphenylene oxide or polypropylene resin material.

* * * * *

UNITED STATES PATENT AND TRADEMARK OFFICE

CERTIFICATE OF CORRECTION

PATENT NO. : 5,508,725

DATED : April 16, 1996

INVENTOR(S) : AKIRA GOTO ET AL.

It is certified that error appears in the above-identified patent and that said Letters Patent is hereby corrected as shown below:

COLUMN 1

Line 17, "a" should read --an--.
Line 59, "a" should read --an--.

COLUMN 2

Line 7, "passages" should read --passage--.
Line 16, "cases" should read --some cases,--.
Lines 55-56, "reference numeral 1502 designates a top plate having" should read --a top plate has--.

COLUMN 3

Line 49, "a" (second occurrence) should read --an--.
Line 60, "a" (second occurrence) should read --an--.

COLUMN 4

Line 8, "a" (second occurrence) should read --an--.
Line 21, "a" (second occurrence) should read --an--.
Line 35, "a" (second occurrence) should read --an--.
Line 51, "a" (second occurrence) should read --an--.

COLUMN 5

Line 13, "illustrates" should read --illustrate--.
Line 38, "248 mm" should read --248 nm--.
Line 48 "same" should read --sake--.

UNITED STATES PATENT AND TRADEMARK OFFICE

CERTIFICATE OF CORRECTION

PATENT NO. : 5,508,725

DATED : April 16, 1996

INVENTOR(S) : AKIRA GOTO ET AL.

It is certified that error appears in the above-identified patent and that said Letters Patent is hereby corrected as shown below:

COLUMN 6

Line 10, "converted" should read --converged--.
Line 14, "plate 1400" should read --plate 1404--.
Line 39, "abrative" should read --ablative--.

COLUMN 7

Line 7, "heat IJH," should read --head IJH,--.

COLUMN 9

Line 2, "good supply" should read --to provide a good supply--.
Line 3, "is" should read --are--.
Line 15, "contacted to" should read --contacting--.
Line 35, "faces" should read --facing--.

COLUMN 10

Line 8, "port 921" should read --port 921 is provided--.
Line 51, "type 918" should read --pipe 918--.

COLUMN 11

Line 5, "take" should read --takes--.
Line 45, "inconventional" should read --in the conventional--.
Line 47, "FIGS. 9- 11," should read --FIGS. 9-11,--.
Line 62, "combined" should read --combined with--.

UNITED STATES PATENT AND TRADEMARK OFFICE

CERTIFICATE OF CORRECTION

PATENT NO. : 5,508,725

DATED : April 16, 1996

INVENTOR(S) : AKIRA GOTO ET AL.

It is certified that error appears in the above-identified patent and that said Letters Patent is hereby corrected as shown below:

COLUMN 12

Line 27, "decreases" should read --decrease--.
Line 33, "surfaces 4010 by" should read --surfaces 4010. By--.

COLUMN 13

Line 52, "confirmed" should read --been confirmed--.

COLUMN 14

Line 19, "top" should read --bottom--.
Line 39, "figuration" should read --figurations--.
Line 42, "case." should read --cases.--.
Line 48, "plate 604" should read --plate 1604--.

COLUMN 15

Line 6, "constitute" should read --constituted--.

COLUMN 16

Line 5, "converted" should read --converged--.
Line 19, "pattern 201" should read --pattern 2201--.
Line 65, "of" should read --are--.

COLUMN 17

Line 2, "system" should read --system;--.
Line 8, "provide" should read --provided--.
Line 62, "head" should read --head,--.

UNITED STATES PATENT AND TRADEMARK OFFICE

CERTIFICATE OF CORRECTION

PATENT NO. : 5,508,725

DATED : April 16, 1996

INVENTOR(S) : AKIRA GOTO ET AL.

It is certified that error appears in the above-identified patent and that said Letters Patent is hereby corrected as shown below:

COLUMN 19

Line 38, "elected," should read --ejected,--.

COLUMN 20

Line 1, "claim 1," should read --claim 8,--.

Signed and Sealed this

Tenth Day of September, 1996

Bruce Lehman

*Attest:*

BRUCE LEHMAN

*Attesting Officer*

*Commissioner of Patents and Trademarks*